US010337244B2

(12) United States Patent
Wang

(10) Patent No.: US 10,337,244 B2
(45) Date of Patent: Jul. 2, 2019

(54) RETRACT GATE

(71) Applicant: YEAGLE DEVELOPMENT CO., LTD., New Taipei (TW)

(72) Inventor: Tsung-Hsiang Wang, New Taipei (TW)

(73) Assignee: YEAGLE DEVELOPMENT CO., LTD., New Taipei (TW)

( * ) Notice: Subject to any disclaimer, the term of this patent is extended or adjusted under 35 U.S.C. 154(b) by 277 days.

(21) Appl. No.: 15/490,257

(22) Filed: Apr. 18, 2017

(65) Prior Publication Data

US 2018/0044982 A1 Feb. 15, 2018

(30) Foreign Application Priority Data

Aug. 9, 2016 (CN) ..... 2016 2 0856208 U

(51) Int. Cl.

| | |
|---|---|
| ***E06B 9/08*** | (2006.01) |
| ***E06B 9/80*** | (2006.01) |
| ***E06B 11/02*** | (2006.01) |
| *E06B 9/00* | (2006.01) |

(52) U.S. Cl.

CPC ..... *E06B 9/80* (2013.01); *E06B 9/08* (2013.01); *E06B 11/027* (2013.01); *E06B 2009/002* (2013.01)

(58) Field of Classification Search

CPC ..... E06B 2009/002; E06B 9/08; E06B 9/56
See application file for complete search history.

(56) References Cited

U.S. PATENT DOCUMENTS

| | | | | |
|---|---|---|---|---|
| 7,438,112 | B2 * | 10/2008 | Cheng | E01F 13/028 160/24 |
| 8,191,604 | B2 * | 6/2012 | Wang | E06B 9/0692 160/23.1 |
| 9,482,052 | B2 * | 11/2016 | Sousa | E01F 13/028 |
| 9,598,896 | B1 * | 3/2017 | Pichik | E06B 9/08 |
| 2002/0179257 | A1 * | 12/2002 | Britto | E06B 9/08 160/291 |
| 2008/0121352 | A1 * | 5/2008 | Cheng | E01F 13/028 160/238 |
| 2011/0088323 | A1 * | 4/2011 | Lundh | E05B 43/00 49/57 |
| 2013/0299101 | A1 * | 11/2013 | Wang | E06B 9/60 160/303 |

* cited by examiner

*Primary Examiner* — Alvin C Chin-Shue
(74) *Attorney, Agent, or Firm* — Rabin & Berdo, P.C.

(57) ABSTRACT

A retract gate has an upper roller assembly, a lower roller assembly, an axial tube, a holding pole, and a screen body. The upper roller assembly has a rolling mechanism and a controlling mechanism. The controlling mechanism has a switch and an engaging component, the engaging component selectively sticking the differential crown gear. Two ends of the axial tube are connected with the upper roller assembly and the lower roller assembly. Two ends of the screen body are securely fixed on the holding pole and the axial tube. When the upper roller assembly is turned on, the rolling mechanism is released; when the upper roller assembly is turned off, the rolling mechanism can memorize the maximum length of the screen body and make the screen body not able to be unrolled further. Consequently, the retract gate can restrict babies and pets within a safe area.

20 Claims, 17 Drawing Sheets

RETRACT GATE

CROSS-REFERENCE TO RELATED APPLICATIONS

This application is based upon and claims priority under 35 U.S.C. 119 from China Patent Application No. 201620856208.8 filed on Aug. 9, 2016, which is hereby specifically incorporated herein by this reference thereto.

BACKGROUND OF THE INVENTION

1. Field of the Invention

The present invention relates to a fence for restricting babies or pets, especially to a retract gate.

2. Description of the Prior Arts

Conventional fences are arranged vertically on the ground for restricting babies or pets so that the babies or pets may not cross a border and approach a dangerous area.

With the advance of technology, retract gates are provided. The conventional retract gate comprises an axial tube and a screen body, the screen body is a cloth, is connected with a surface of the axial tube, and is rolled on the surface of the axial tube. When a free end of the screen body is pulled, the axial tube can rotate and the screen body is unrolled from the axial tube. After that, the free end of the screen body is capable of hooking on a hook fixed on a wall or a fixed object and thereby the screen body is fixed.

To be more convenient, the axial tube comprises a third elastic element for pulling the screen body backward, so that the screen body can be rolled again automatically. Precisely, the third elastic element keeps forcing the axial tube to rotate backward, which causes the screen body to be rolled on the axial tube after the free end of the screen body is detached from the hook. Thus, a convenience of the conventional retract gate is improved.

However, because the conventional retract gate does not comprise additional secure mechanism, the screen body, even hooked on the hook, is still capable of being unrolled by an external force. Furthermore, when the babies or pets pull or push the screen body, the unrolled portion of the screen body becomes longer, which may cause the screen body to detach from the hook.

To overcome the shortcomings, the present invention provides a retract gate to mitigate or obviate the aforementioned problems.

SUMMARY OF THE INVENTION

The main objective of the present invention is to provide a retract gate that can memorize a fixed length of the screen body such that the screen body may not be pulled longer than expected.

The retract gate has:

an upper roller assembly comprising:
- a housing;
- a rolling mechanism accommodated in the housing and comprising:
  - a sleeve having:
    - upper teeth formed on an upper end of the sleeve; and
    - surrounding teeth annually formed on an outer surface of the sleeve;
  - a differential crown gear having teeth;
  - a first crown gear having teeth, a number of the teeth of the first crown gear being less than that of the differential crown gear; and

- at least one gear engaging the upper teeth of the sleeve, the first crown gear, and the differential crown gear;
  - wherein the sleeve, the differential crown gear, and the first crown gear rotate coaxially; and
- a controlling mechanism accommodated in the housing and comprising:
  - a switch capable of moving relatively to the housing and engaging with the first crown gear, part of the switch extending out of the housing; and
  - an engaging component selectively and slidably abutting the switch; the engaging component selectively sticking the differential crown gear;

a lower roller assembly;

an axial tube, one end of the axial tube connected with the sleeve, another end of the axial tube connected with the lower roller assembly; the axial tube rotated with the sleeve but rotated relatively to the lower roller assembly;

a holding pole; and a screen body, one end of the screen body securely fixed on the holding pole, another end of the screen body securely fixed on the axial tube; the screen body selectively rolled on an outer side of the axial tube;

wherein when the upper roller assembly is turned on by the switch, the switch releases the first crown gear and the engaging component releases the sleeve; and wherein when the upper roller assembly is turned off by the switch, the switch engages the first crown gear; meanwhile:
- at a time when the engaging component sticks the differential crown gear, the engaging component engages the sleeve; and
- at a time when the engaging component releases the differential crown gear, the engaging component also releases the sleeve.

Therefore, when the upper roller assembly is turned off, the maximum length of the screen body is determined and memorized, which causes the screen body not able to be unrolled further. Thus, the retract gate can restrict babies and pets within a safe area.

Other objectives, advantages and novel features of the invention will become more apparent from the following detailed description when taken in conjunction with the accompanying drawings.

BRIEF DESCRIPTION OF THE DRAWINGS

FIG. 6B is a sectional view of the upper roller assembly of the retract gate in FIG. 1 when the upper roller assembly is turned on;

FIG. 7B is another sectional view of the upper roller assembly of the retract gate in FIG. 1 when the upper roller assembly is turned on;

FIG. 8B is still another sectional view of the upper roller assembly of the retract gate in FIG. 1 when the upper roller assembly is turned on;

FIG. 9B is further another sectional view of the upper roller assembly of the retract gate in FIG. 1 when the upper roller assembly is turned on;

DETAILED DESCRIPTION OF THE PREFERRED EMBODIMENTS

Figure 1:
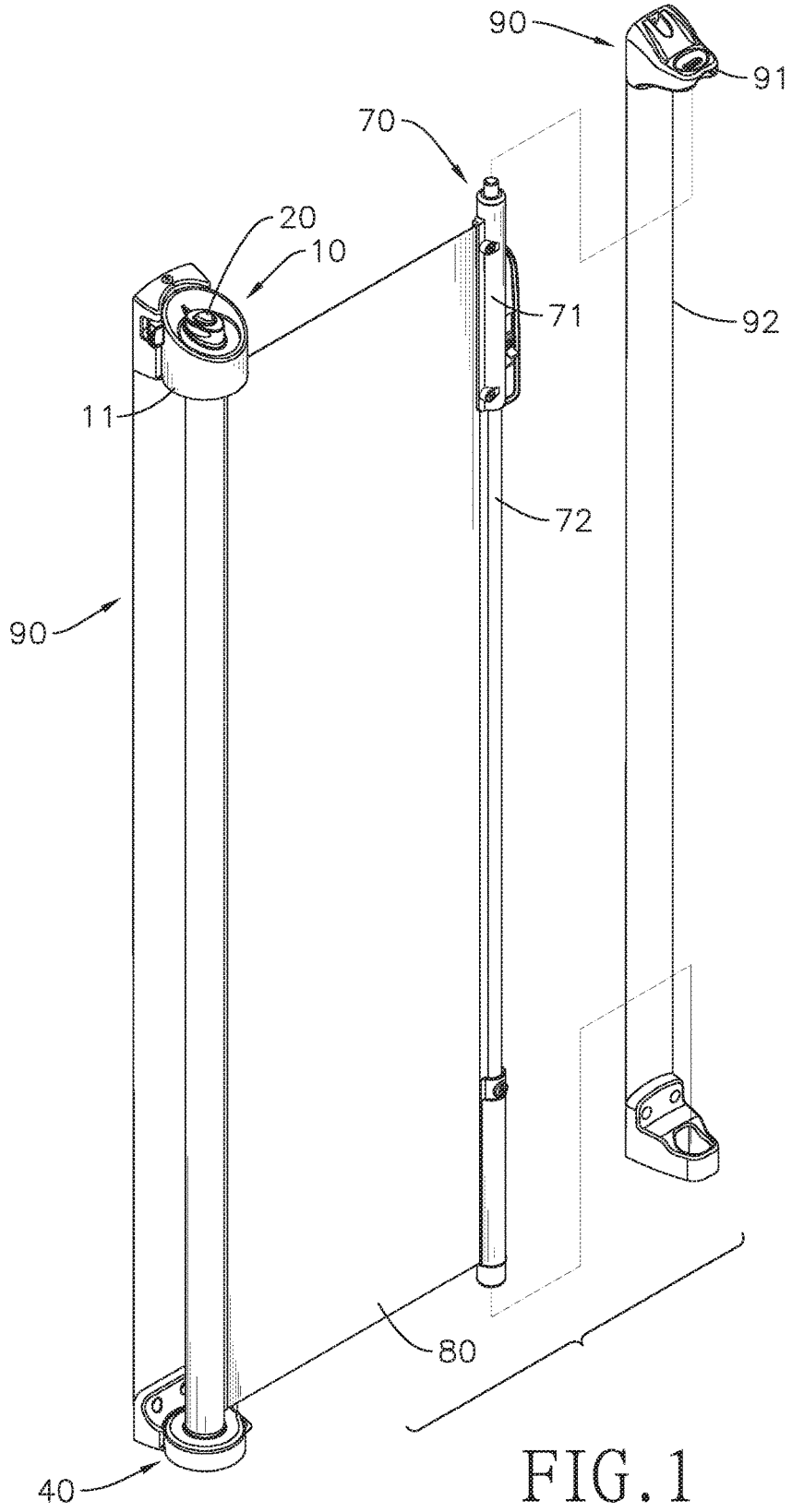
FIG. 1 is a perspective view of a retract gate in accordance with the present invention.
Figure 2:
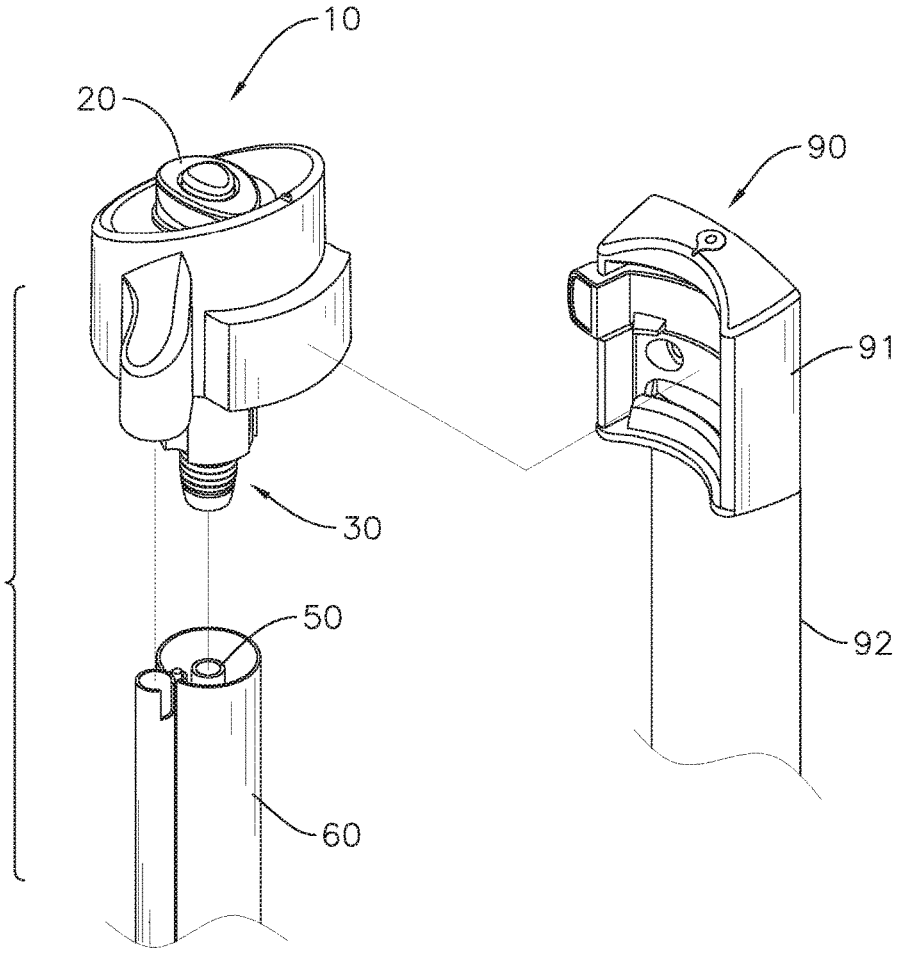
FIG. 2 is a partial exploded perspective view of the retract gate in FIG. 1.

With reference to FIGS. 1 and 2, a retract gate in accordance with the present invention comprises an upper roller assembly 10, a lower roller assembly 40, an axial pole 50, an axial tube 60, a holding pole 70, a screen body 80, and two fixing components 90.

Figure 3:
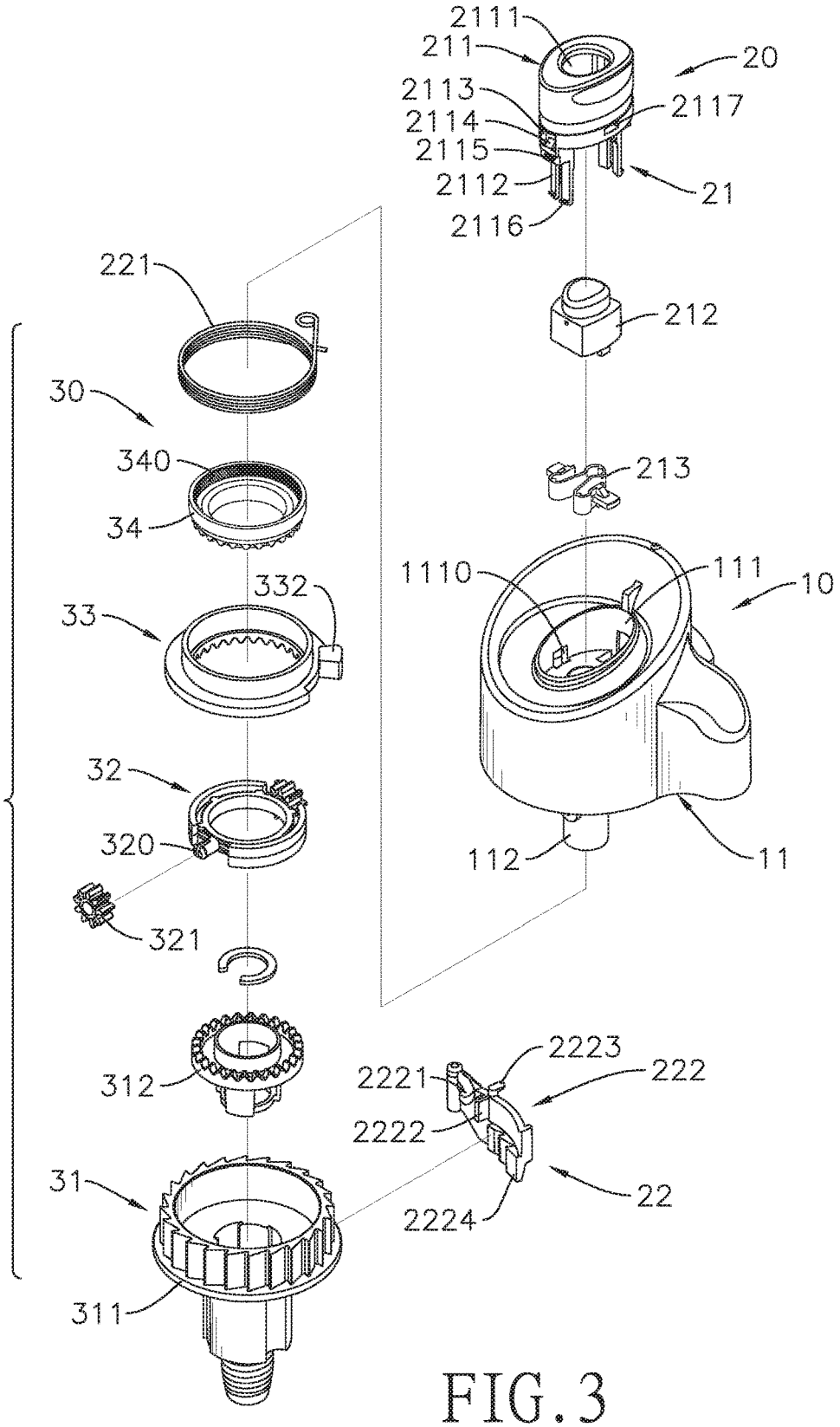
FIG. 3 is an exploded perspective view of an upper roller assembly of the retract gate in FIG. 1.
Figure 3A:
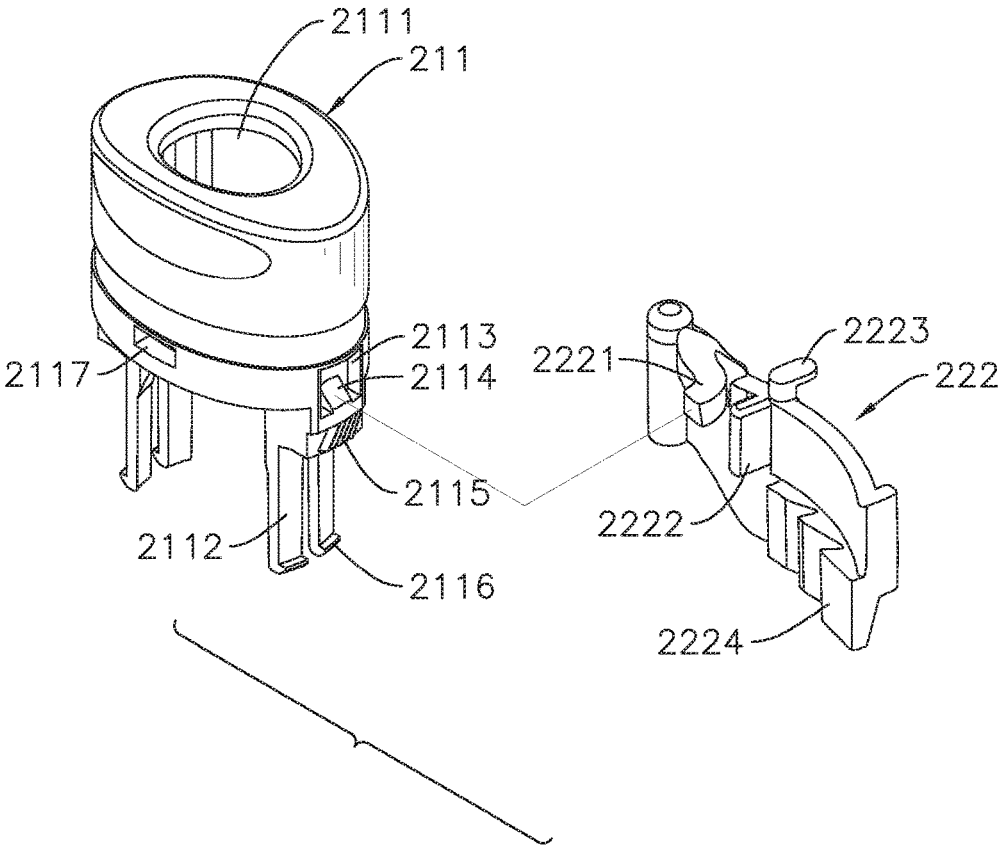
FIG. 3A is a perspective view of a first button and an engaging body of the retract gate in FIG. 1.
Figure 4:
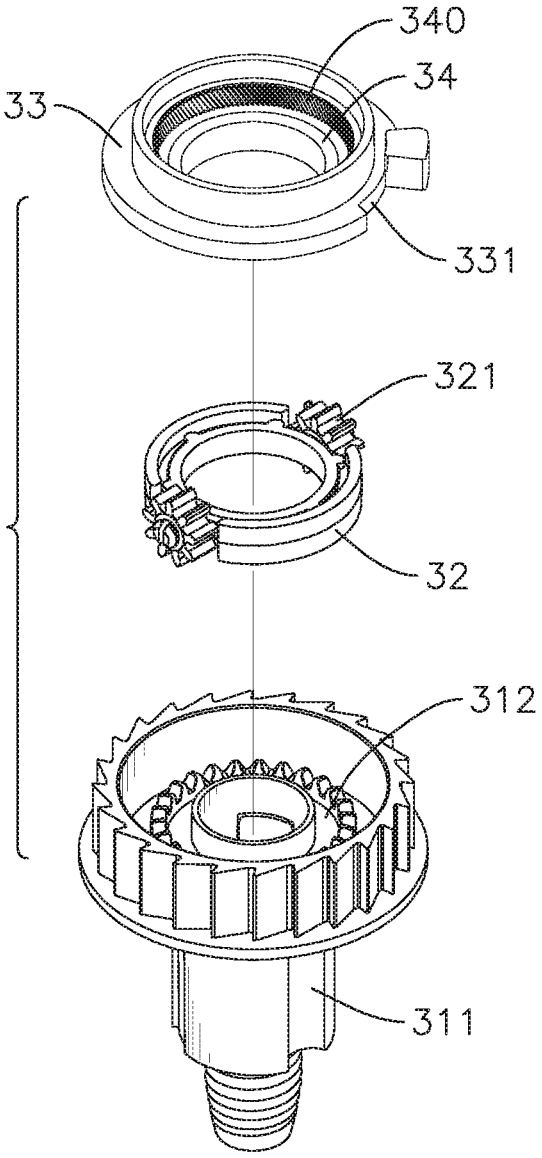
FIG. 4 is another exploded perspective view of the upper roller assembly of the retract gate in FIG. 1.

Please refer to FIGS. 2 to 4. The upper roller assembly 10 comprises a housing 11, a controlling mechanism 20, and a rolling mechanism 30. The housing 11 has an accommodating space 111 and a fixing rod 112. The accommodating space 111 is formed on a top of the housing 11 and forms at least one sticking hole 1110. The fixing rod 112 is formed in the housing 11, one end of the fixing rod 112 is mounted on an outer surface of a bottom of the accommodating space 111, and another end of the fixing rod 112 is connected with an upper end of the axial pole 50. In this embodiment, the fixing rod 112 is fixed securely on the axial pole 50 by a screw.

Please refer to FIGS. 3, 3A, 6A and 7A. The controlling mechanism 20 is accommodated in the housing 11 and comprises a switch 21 and an engaging component 22.

The switch 21 is accommodated in the accommodating space 111 of the housing 11 but part of the switch 21 extends out of the housing 11. The switch 21 is capable of moving relative to the housing 11 and comprises a first button 211, a second button 212, and a second elastic element 213.

The first button 211 is hollow and is movably mounted in the accommodating space 111 of the housing 11 but part of the first button 211 extends out of the housing 11. The first button 211 forms a through hole 2111, two extending portions 2112, and two penetrated holes 2117. The two extending portions 2112 are formed on two sides of the first button 211 respectively. Each extending portion 2112 is elongated and extends downward from a bottom of the first button 211. Therefore, each extending portion 2112 penetrates throughout the accommodating space 111 of the housing 11.

Each extending portion 2112 has a recess 2113, a first tooth portion 2115 on an upper end of the extending portion 2112, and a protrusion 2116 at a lower end of the extending portion 2112. In other words, the recess 2113 and the first tooth portion 2115 are on the same side of the first button 211 in this embodiment, but it is not limited thereto.

The recess 2113 has a slope 2114. The slope 2114 is formed in the recess 2113 and at a lower portion of the recess 2113. The slope 2114 inclines outward. The first tooth portion 2115 is formed under the recess 2113 and comprises a plurality of teeth. The first tooth portion 2115 of the switch 21 is inclined rightward from a lower part to an upper part of the first tooth portion 2115.

The protrusion 2116 of each extending portion 2112 extends outward and selectively hooks the rolling mechanism 30.

The second button 212 is movably mounted in the through hole 2111 of the first button 211, but part of the second button 212 extends out of the first button 211.

The second elastic element 213 abuts a bottom of the second button 212 and is retractably mounted in the first button 211. Part of the second elastic element 213 selectively extends out of the first button 211 and thus sticks in the at least one sticking hole 1110 of the housing 11.

The engaging component 22 selectively and slidably abuts the switch 21 and selectively engages the rolling mechanism 30. The engaging component 22 comprises a first elastic element 221 and an engaging body 222. The first elastic element 221 is sleeved on the rolling mechanism 30. One end of the first elastic element 221 is mounted on the rolling mechanism 30, and another end of the first elastic element 221 is mounted on the engaging body 222.

The engaging body 222 comprises an abutting portion 2221, a stopping portion 2222, a fixing portion 2223 and a second tooth portion 2224. The abutting portion 2221 is a column extending inward and selectively abuts the recess 2113. While abutting the recess 2113, the abutting portion 2221 is capable of sliding alternately on the slope 2114 of the recess 2113 and a bottom surface of the recess 2113. The bottom surface of the recess 2113 is the innermost surface of the recess 2113, and, in this embodiment, the bottom surface is vertical. The stopping portion 2222 is a block protruding inward and selectively sticks the rolling mechanism 30. The fixing portion 2223 is a column extending outward. Said another end of the first elastic element 221 is mounted on the fixing portion 2223 of the engaging body 222. The second tooth portion 2224 has one or more teeth facing inward and selectively engaging with the rolling mechanism 30. Precisely, each tooth of the second tooth portion 2224 is tilted in the rolling direction.

Please refer to FIGS. 3 to 5, and 6A. The rolling mechanism 30 is accommodated in the housing 11 and is capable of rotating in a rolling direction and an unrolling direction. The rolling mechanism 30 comprises a sleeve 31, a ring 32, at least one gear 321, a differential crown gear 33, and a first crown gear 34.

The sleeve 31 is rotatably sleeved on the fixing rod 112 and is connected with the axial tube 60, and the second tooth portion 2224 of the engaging body 222 selectively engages the sleeve 31. The sleeve 31 has upper teeth and surrounding teeth; the surrounding teeth are annually formed on an outer surface of the sleeve 31, and the upper teeth are annually formed on an upper end of the sleeve 31. Precisely, the sleeve 31 comprises a gear sleeve 311 and a second crown gear 312, the surrounding teeth are annually formed on an outer surface of the gear sleeve 311, and the upper teeth are annually formed on an upper end of the second crown gear 312. The gear sleeve 311 is rotatably sleeved on the fixing rod 112 and is connected with the axial tube 60, which causes the gear sleeve 311 to be rotated by the axial tube 60.

Each surrounding tooth of the gear sleeve 311 is tiled in the unrolling direction, which allows the second tooth portion 2224 of the engaging body 222 to engage the gear sleeve 311. The second crown gear 312 is also rotatably sleeved on the fixing rod 112 and is securely fixed in the gear sleeve 311 concentrically.

The ring 32 is also rotatably sleeved on the fixing rod 112 and is located on the second crown gear 312. The ring 32 is selectively hooked by the protrusions 2116 of the extending portions 2112 and thereby the ring 32 is capable of moving with the first button 211. The ring 32 forms at least one rod 320 extending outward. The at least one gear 321 is rotatably sleeved on the at least one rod 320. The at least one gear 321 engages with the upper teeth of the second crown gear 312. In other words, the second crown gear 312 engages on a lower side of the at least one gear 321. In this embodiment, numbers of the at least one rod 320 and the at least one gear 321 are both two, and the two rods 320 are located on two sides of the ring 32.

The differential crown gear 33 is also rotatably sleeved on the fixing rod 112 and is located on the ring 32. The differential crown gear 33 has teeth, a cavity 331, and a hook portion 332. The teeth of the differential crown gear 33 are faced downward. The cavity 331 is formed on an outer periphery of the differential crown gear 33. The stopping portion 2222 of the engaging component 22 selectively sticks in the cavity 331 of the differential crown gear 33 and thus the differential crown gear 33 cannot rotate. The first elastic element 221 is sleeved on an outer surface of the differential crown gear 33 and said one end of the first elastic element 221 fixed at the hook portion 332 of the differential crown gear 33.

The first crown gear 34 is also rotatably sleeved on the fixing rod 112, but is further concentrically sleeved in the differential crown gear 33 in this embodiment but it is not limited thereto. In other words, the first crown gear 34 and the differential crown gear 33 can rotate with respect to each other. The first crown gear 34 has teeth faced downward, and a number of the teeth of the first crown gear 34 is less than that of the differential crown gear 33 by one or two. The teeth of both the first crown gear 34 and the differential crown gear 33 engage with an upper side of the gears 321.

The first button 211 of the switch 21 selectively engages with the first crown gear 34. Precisely, the first crown gear 34 further has annular teeth 340, and the annular teeth 340 are formed on an inner surface of the first crown gear 34 and are arranged annularly. The annular teeth 340 of the first crown gear 34 are inclined corresponding to the first tooth portion 2115 of the first button 211 of the switch 21. Thus, the first tooth portion 2115 is capable of engaging the annular teeth 340.

Briefly, the first crown gear 34, the ring 32, and the second crown gear 312 of the sleeve 31 are sleeved on the fixing rod 112 in series from top to bottom. Therefore, the axial tube 60 drives the gear sleeve 311 to rotate, the gear sleeve 311 drives the second crown gear 312 to rotate, the second crown gear 312 drives the gears 321 and the ring 32 to rotate, and then the gears 321 drive the first crown gear 34 or the differential crown gear 33 to rotate.

Figure 10:
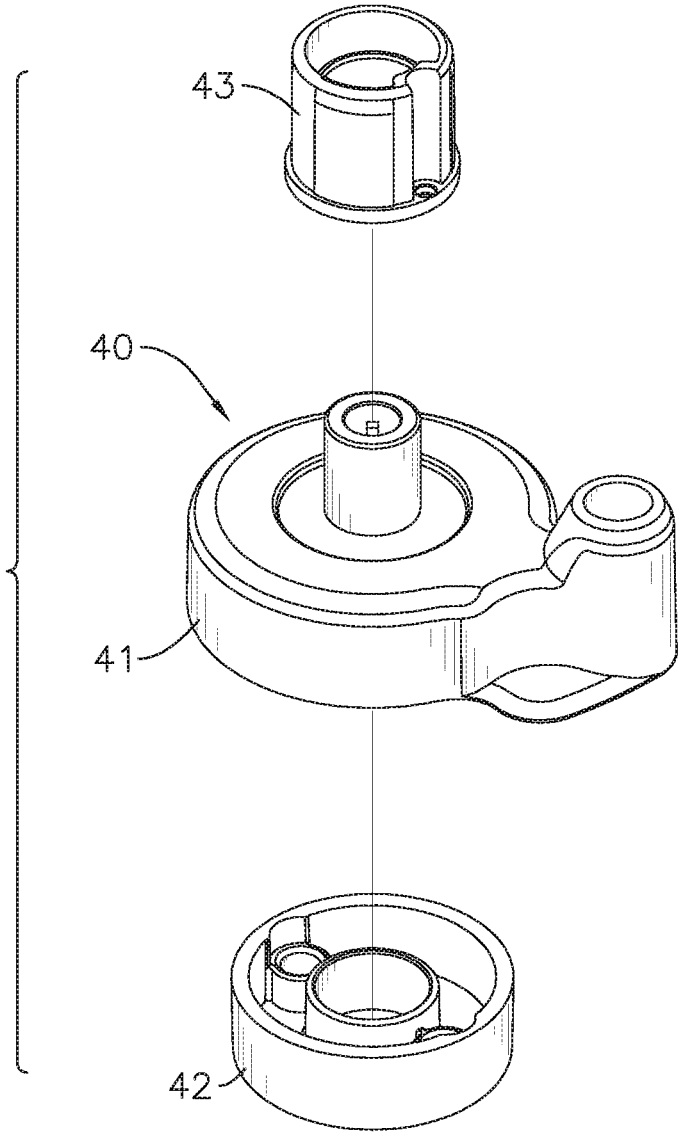
FIG. 10 is an exploded perspective view of a lower roller assembly of the retract gate in FIG. 1.

Please refer to FIGS. 1 and 10. The lower roller assembly 40 has a base 41, a lid 42, and a collar 43. The lid 42 is mounted on the base 41, and the collar 43 is sleeved on the base 41. The base 41 is fixed with a lower end of the axial pole 50. In this embodiment, the base 41 is fixed securely with the axial pole 50 by a screw.

The axial tube 60 is sleeved on the collar 43 and the axial pole 50 and is capable of rotating with respect to the axial pole 50 and the lower roller assembly 40. Precisely, an upper end of the axial tube 60 is securely sleeved on the gear sleeve 311 of the sleeve 31, and a lower end of the axial tube 60 is fixed on the collar 43. Thus, the axial tube 60 rotates synchronously with the sleeve 31 but rotated with respect to the axial pole 50 and the lower roller assembly 40. The axial tube 60 tends to automatically rotate in the rolling direction. The axial tube 60 is made of aluminum, but it is not limited thereto.

Figure 11:
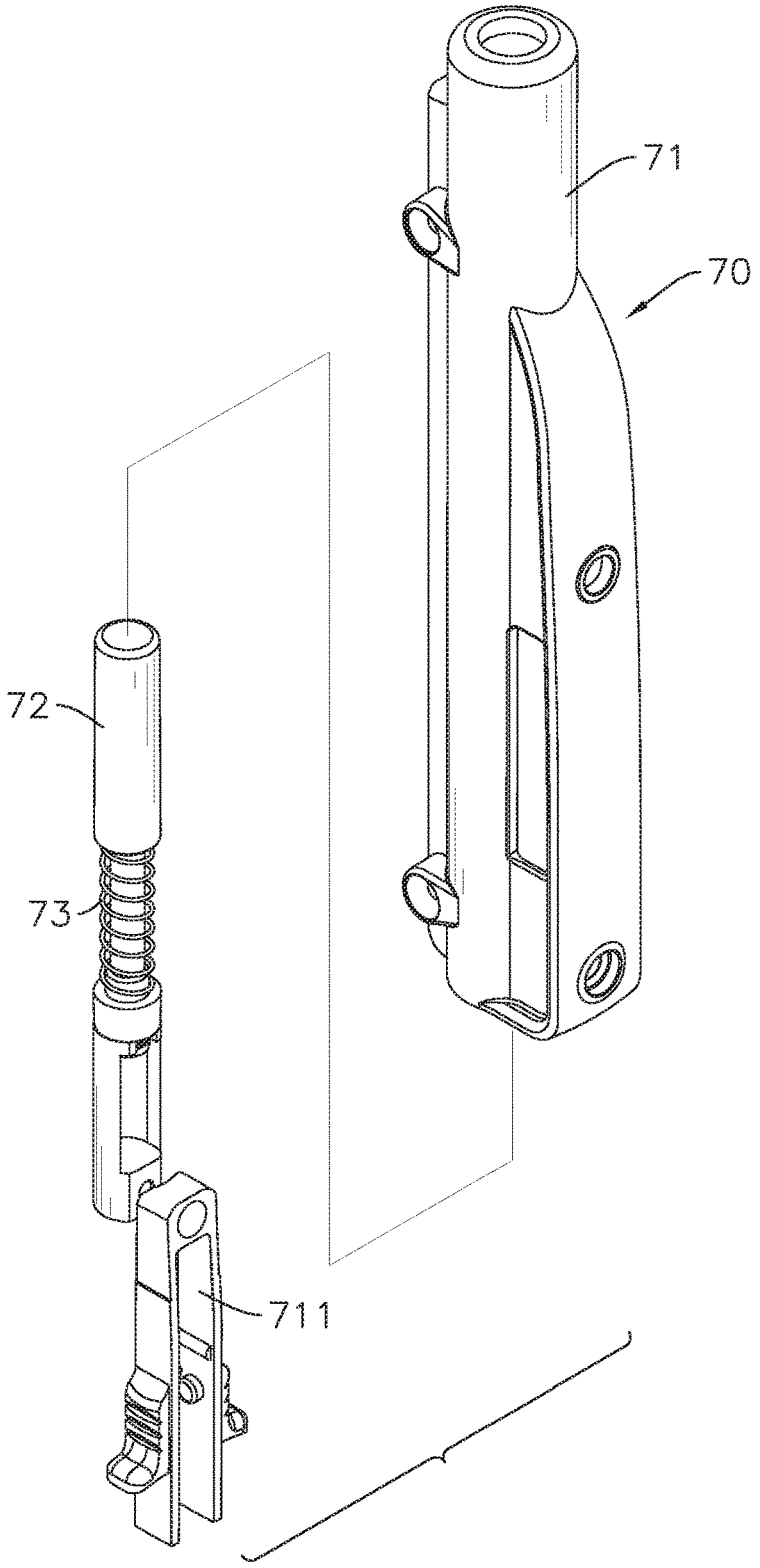
FIG. 11 is an exploded perspective view of a holding pole of the retract gate in FIG. 1.

Please refer to FIGS. 1 and 11. The holding pole 70 comprises a handle 71, a pole 72, and a third elastic element 73. The handle 71 has a push bolt 711. The push bolt 711, the pole 72, and the third elastic element 73 are accommodated in the handle 71. The pole 72 is connected with the push bolt 711. The third elastic element 73 is sleeved or mounted on the pole 72. The pole 72 is abutted by the push bolt 711 so that the push bolt 711 is capable of driving the pole 72.

Please refer to FIGS. 1 and 2. One end of the screen body 80 is securely fixed on the holding pole 70, and another end of the screen body 80 is securely fixed on the axial tube 60. The screen body 80 is capable of rolling on an outer side of the axial tube 60. The screen body 80 is made of gauze, nylon, etc.

The two fixing components 90 are fixed on walls or flat surfaces and are spaced apart from each other, e.g. the two fixing components 90 are fixed on two sides of a frame of a door. Each fixing component 90 comprises two fixing stands 91 and a fixing board 92. The two fixing stands 91 are securely mounted on two ends of the fixing board 92 respectively. Therefore, distances between the two fixing stands 91 are decided and equal to lengths of the axial tube 60 and the holding pole 70. Besides, when the retract gate is installed, if the walls are not flat enough, the fixing board 92 may be mounted on the rugged wall first, and then the fixing stands 91 are mounted on the fixing board 92. Furthermore, when the retract gate is installed completely, the fixing boards 92 of each fixing component 90 can be dismounted from the walls, which causes spaces between the two fixing stands 91 of each fixing component 90 to be enlarged so that the axial tube 60 and the holding pole 70 can be used without any obstruction.

The housing 11 of the upper roller assembly 10 is mounted on one of the fixing stands 91 of one of the fixing components 90, and the base 41 of the lower roller assembly 40 is mounted on the other one of the two fixing stands 91 of said fixing component 90. Thus, the axial pole 50 and the axial tube 60 are secured. Two ends of the holding pole 70 are detachably mounted in the two fixing stands 91 of the other fixing component 90.

With the aforesaid structure, the retract gate of the present invention can memorize length of the unrolled screen body 80. Precisely, when the upper roller assembly is turned on, the screen body 80 can be pulled without restriction; but when the upper roller assembly is turned off, the maximum unrolled length of the screen body 80 is determined and memorized.

Figure 6A:
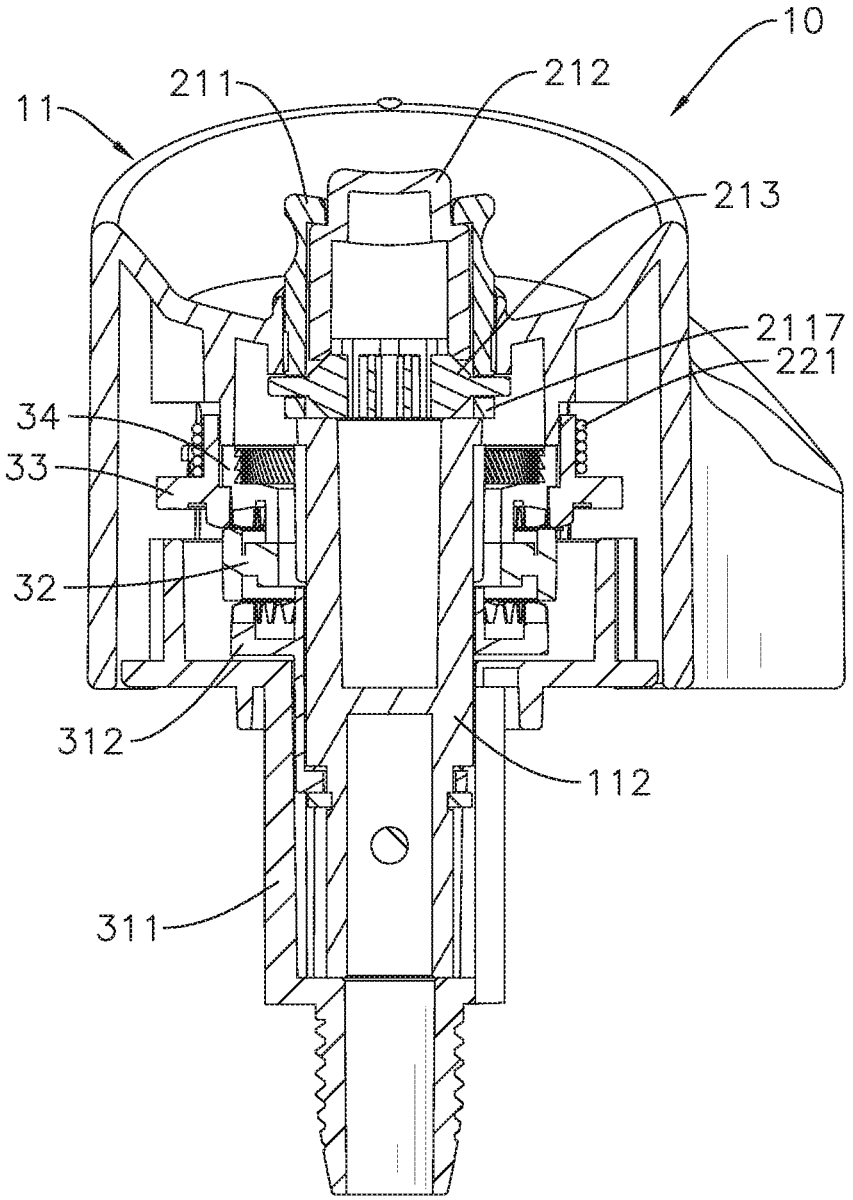
FIG. 6A is a sectional view of the upper roller assembly of the retract gate in FIG. 1 when the upper roller assembly is turned off.
Figure 9A:
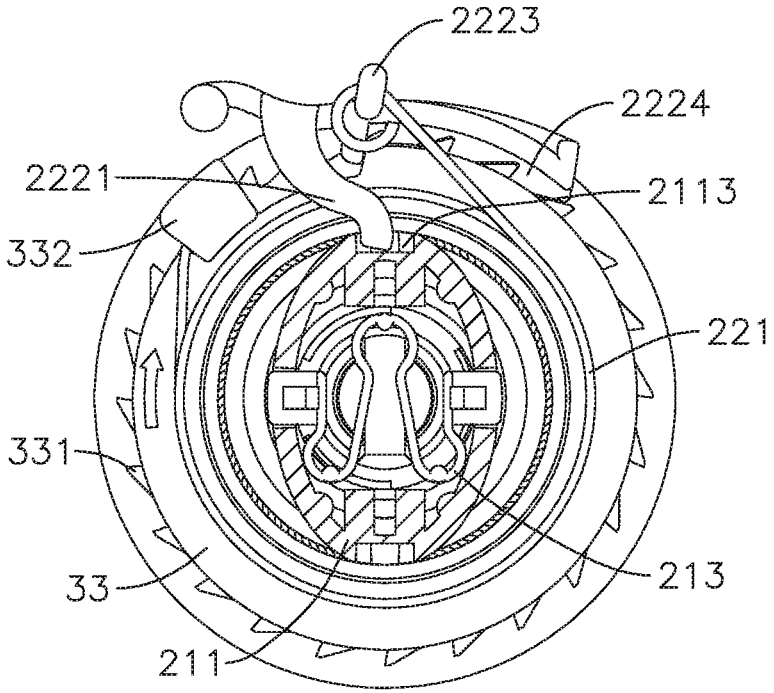
FIG. 9A is further another sectional view of the upper roller assembly of the retract gate in FIG. 1 when the upper roller assembly is turned off.
Figure 9B:
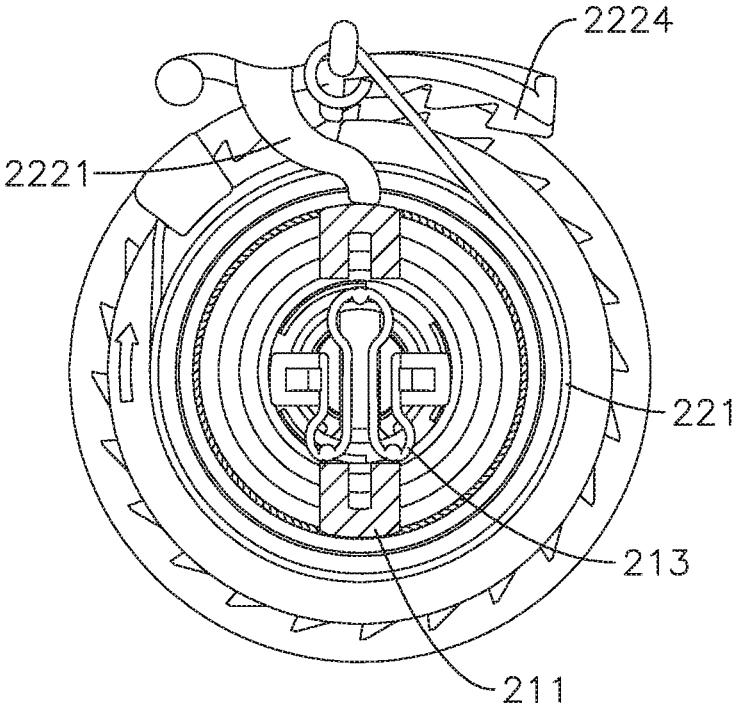

Please refer to FIGS. 6A to 9B. The switch 21 is pulled up, which means that the switch 21 turns on the upper roller assembly; the switch 21 is pressed down, which means that the switch 21 turns off the upper roller assembly. The following is a specific course to use the retract gate of the present invention:

Usually, according to FIGS. 6A and 9A, the second elastic element 213 extends out and through the penetrated holes 2117 of the first button 211, and sticks in the at least one sticking hole 1110 of the accommodating space 111 of the housing 11, thus the first button 211 is locked.

Figure 6B:
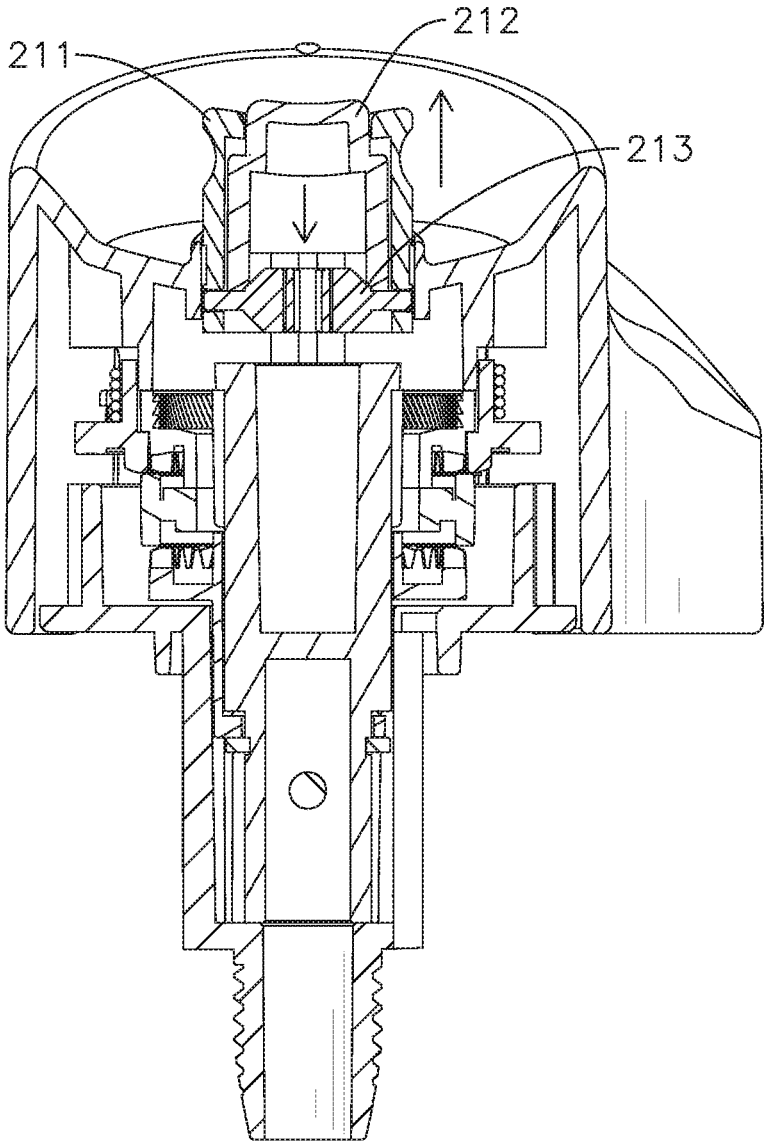
Figure 7A:
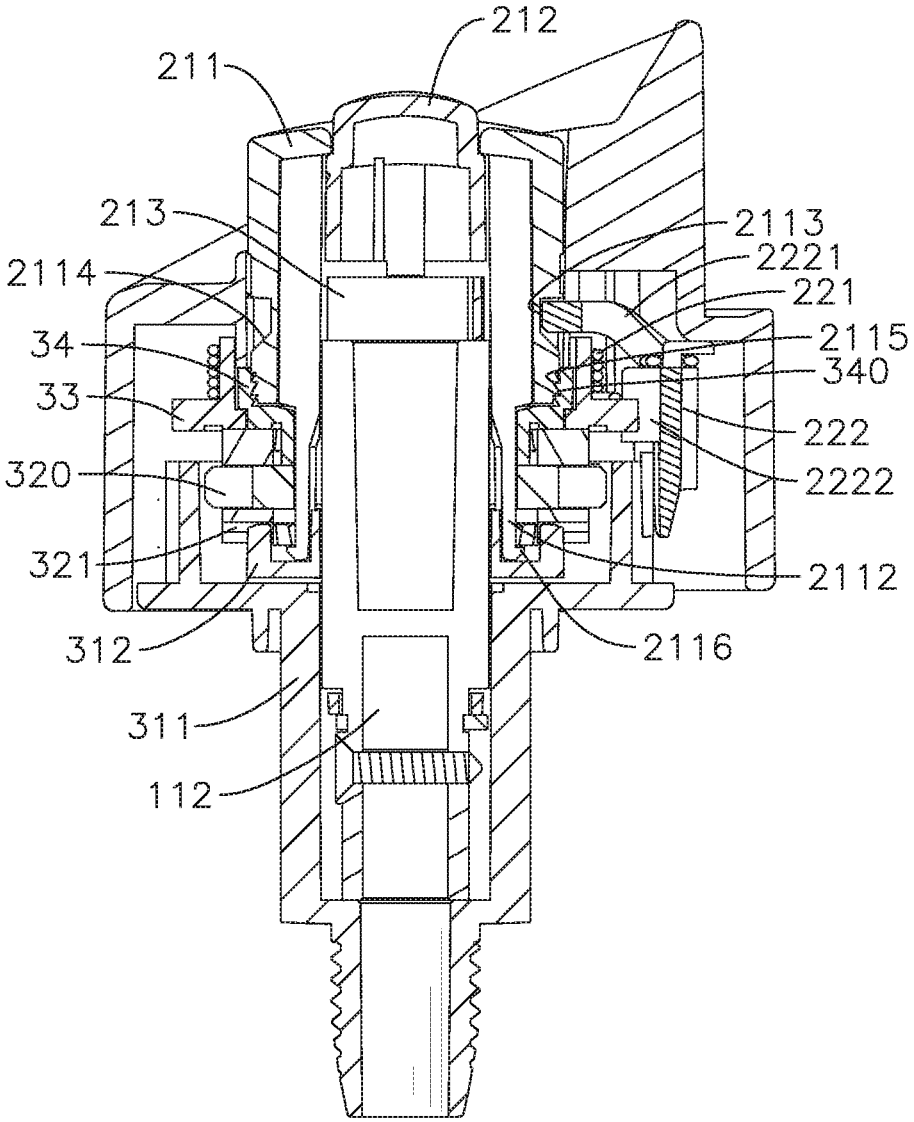
FIG. 7A is another sectional view of the upper roller assembly of the retract gate in FIG. 1 when the upper roller assembly is turned off.
Figure 7B:
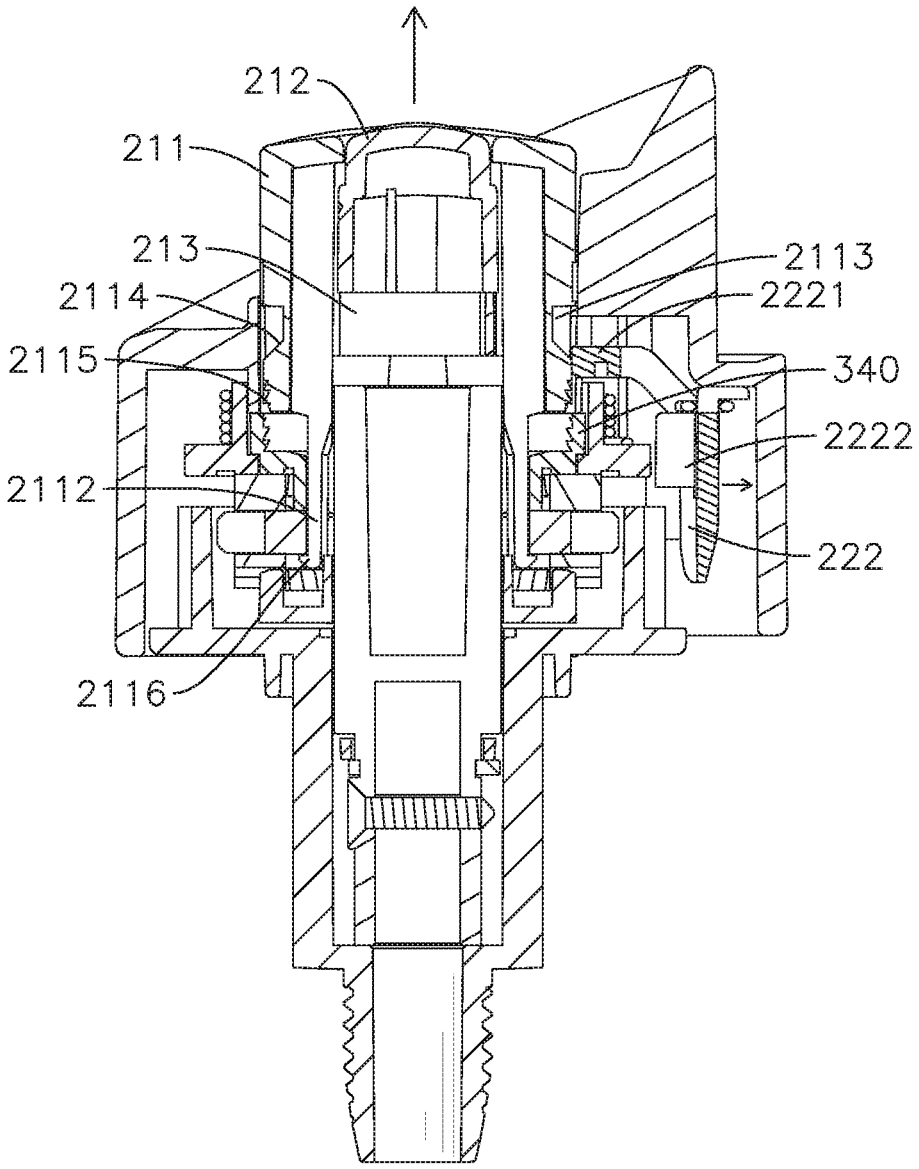

According to FIGS. 6A and 6B, when the second button 212 is pressed down, the second button 212 abuts the two inclined protrusions 2116 on the second elastic element 213, which causes the second elastic element 213 to retract into the first button 211 and depart from the accommodating space 111. Meanwhile, the first button 211 is unlocked and can be pulled up.

After the first button 211 is pulled up, the upper roller assembly is turned on.

According to FIGS. 6B, 7B, 8B and 9B, when the upper roller assembly is turned on, the switch 21 releases the first crown gear 34 and the engaging component 22 releases the sleeve 31, and thereby the axial tube 60 is capable of rotating with the sleeve 31 in both a rolling direction and an unrolling direction. Precisely, the first tooth portion 2115 of the first button 211 moves up and releases the annular teeth 340 of the first crown gear 34, so that the first crown gear 34 can rotate freely.

Besides, because of the first elastic element 221 connecting the differential crown gear 33 and the engaging body 222, the differential crown gear 33 does not rotate with respect to the engaging body 222 without enough external force. In other words, the differential crown gear 33 does not rotate at this time. In addition, with the first elastic element 221, the abutting portion 2221 of the engaging body 222 keeps abutting on the recess 2113 of the first button 211.

Therefore, after the first button 211 is pulled up, the recess 2113 slides with respect to the abutting portion 2221 so that the abutting portion 2221 abuts on the outermost portion of the slope 2114 of the recess 2113, which causes the engaging body 222 to be pushed away from the sleeve 31 and the second tooth portion 2224 of the engaging body 222 to release the gear sleeve 311 of the sleeve 31. Thus, the sleeve 31 and the axial tube 60 can be rotated without restriction and thereby the screen body 80 can be unrolled in any length.

Then, the holding pole 70 is pulled to rotate the axial tube 60 in the unrolling direction, so that the screen body 80 is unrolled. Meanwhile, the axial tube 60 drives the gear sleeve 311, the second crown gear 312, the ring 32 and the gears 321, and the first crown gear 34 to rotate, until the holding pole 70 is fixed in the two fixing stands 91 of the fixing component 90. At this time, the pole 72 is pushed into the fixing stand 91 by the push bolt 711 so that the holding pole 70 is secured in the fixing stand 91.

According to FIGS. 6A, 7A, 8A and 9A, when the first button 211 is pressed down so that the upper roller assembly is turned off, the maximum unrolled length of the screen body 80 is determined and memorized.

When the upper roller assembly is turned off, the tooth portion 116 of the first button 211 of the switch 21 engages the annular teeth 340 of the first crown gear 34. Furthermore, because the tooth portion 116 and the annular teeth 340 are inclined correspondingly, the first button 211 may drive the first crown gear 34 to rotate in the rolling direction slightly before the tooth portion 116 completely engages the annular teeth 340. And after engaging with the first button 211 completely, the first crown gear 34 is secured and may not rotate anymore in any direction.

Besides, when the first button 211 is pressed down, the recess 2113 slides with respect to the abutting portion 2221 so that the abutting portion 2221 abuts the bottom surface of the recess 2113, which causes the engaging body 222 to be pulled inward by the first elastic element 221, the second tooth portion 2224 of the engaging body 222 to engage the gear sleeve 311 of the sleeve 31, and the stopping portion 2222 of the engaging body 222 to stick in the cavity 331 of the differential crown gear 33, and thereby the differential crown gear 33 cannot rotate.

With the second tooth portion 2224 engages the gear sleeve 311, the sleeve 31 can only rotate in the rolling direction. However, after the sleeve 31 rotates and the screen body 80 is rolled a little bit backward on the axial tube 60 , the second crown gear 312 of the sleeve 31 may rotate in the rolling direction, which causes the gear sleeve 311 of the sleeve 31 to push the engaging body 222 away from the rolling mechanism 30 so that the stopping portion 2222 releases the differential crown gear 33.

Figure 5:
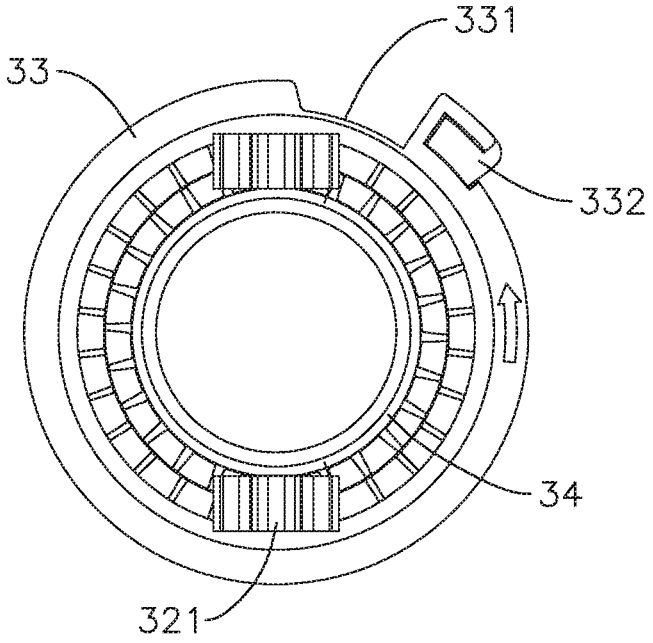
FIG. 5 is a bottom perspective view of a differential crown gear and a first crown gear of the retract gate in FIG. 1.

As shown in FIG. 5, as long as the second crown gear 312 rotates in the rolling direction, the ring 32 also rotates in the rolling direction and the gears 321 drive the differential crown gear 33 to rotate in the rolling direction, but the differential crown gear 33 is rotated no more than one circle preferably. Precisely, with the first crown gear 34 secured by the first button 211, the number of the teeth of the first crown gear 34 is less than that of the differential crown gear 33, and the gears 321 on the ring 32 drive the differential crown gear 33 to rotate with respect to the first crown gear 34.

Figure 8A:
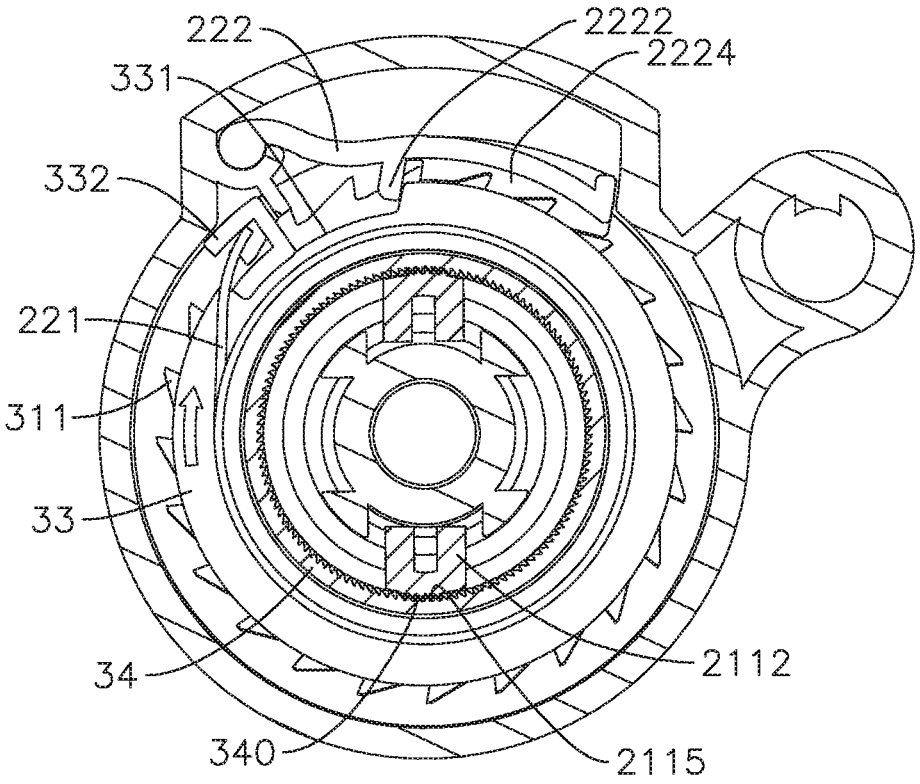
FIG. 8A is still another sectional view of the upper roller assembly of the retract gate in FIG. 1 when the upper roller assembly is turned off.
Figure 8B:
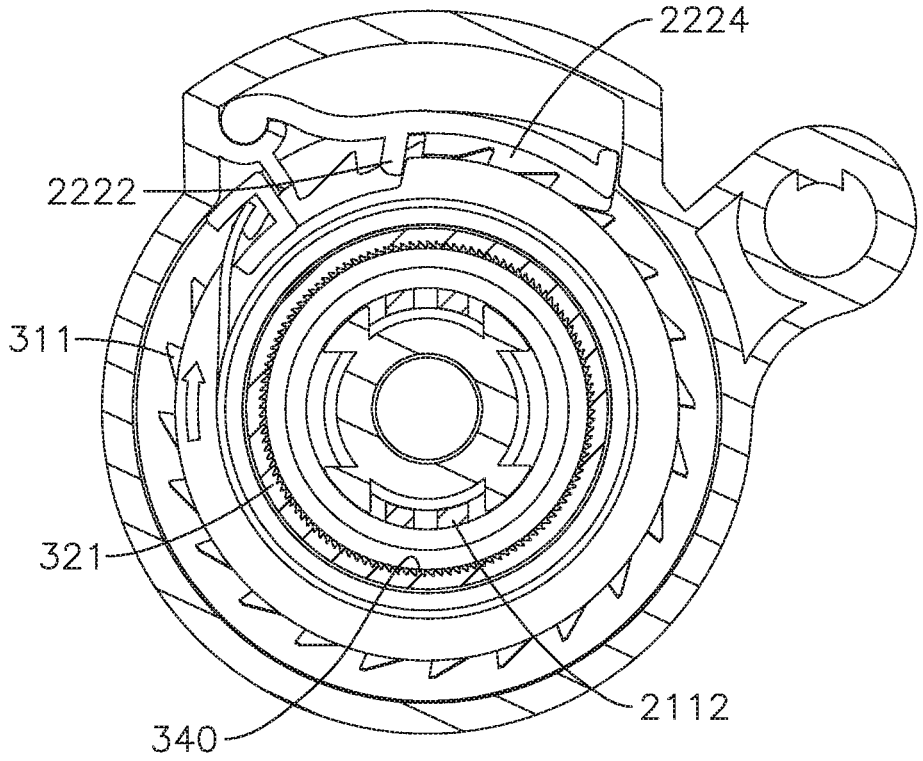
Figure 8C:
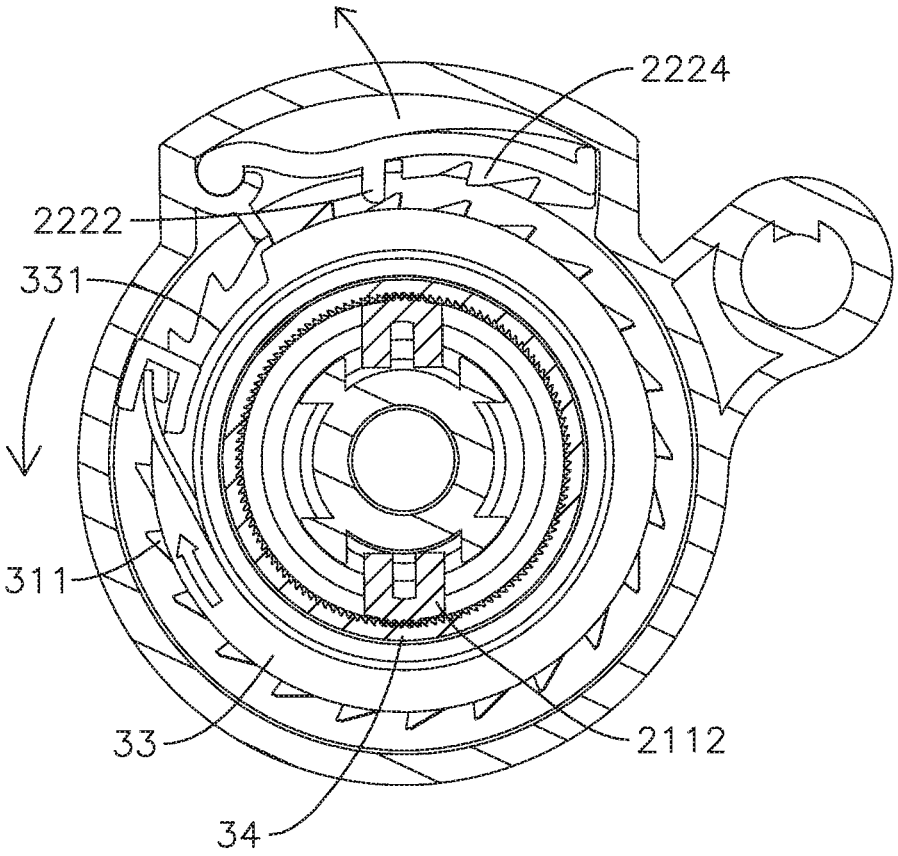
FIG. 8C is a sectional view of the upper roller assembly of the retract gate in FIG. 1 when the differential crown gear is rotated back.

According to FIG. 8C, after the differential crown gear 33 is rotated for a while, the cavity 331 of the differential crown gear 33 does not face to the stopping portion 2222. Therefore, when the screen body 80 stops rolling backward and the sleeve 31 stops rotating, the first elastic element 221 pulls the engaging body 222 backward, but the stopping portion 2222 no longer sticks in the cavity 331 of the differential crown gear 33 but abuts on the outer periphery of the differential crown gear 33 instead. Thus, the engaging body 222 no longer engages the rolling mechanism 30, so that the abutting portion 2221 is apart from the recess 2113 and the second tooth portion 2224 releases the gear sleeve 311. Thus, the sleeve 31 can rotate freely in both the rolling direction and the unrolling direction.

At that time, the screen body 80 can be rolled back on the axial tube 60 completely. Besides, when the holding pole 70 is pulled again and the screen body 80 approaches the determined maximum unrolled length, the gears 321 drive the differential crown gear 33 to rotate backward in the unrolling direction so that the cavity 331 of the differential crown gear 33 faces to the stopping portion 2222 again.

Therefore, the first elastic element 221 pulls the engaging body 222 backward and the stopping portion 2222 sticks in the cavity 331 again, which makes the differential crown gear 33 no longer rotate in the unrolling direction. Meanwhile, the gears 321 are stuck by the differential crown gear 33 and the first crown gear 34, and then the sleeve 31 is stuck in by the gears 321, so the axial tube 60 cannot be rotated in the unrolling direction anymore. In other words, the screen body 80 may not be pulled longer than the determined maximum unrolled length.

In other words, no matter to what degree the differential crown gear 33 is rotated in the rolling direction by the axial tube 60, the differential crown gear 33 can only rotate backward in the unrolling direction in the same degrees, which memorizes a rotation degree of the differential crown gear 33 so that the maximum unrolled length of the screen body 80 is also memorized.

Consequently, when the upper roller assembly 10 is turned off, the maximum length of the screen body 80 is determined and memorized, which causes the screen body 80 unable to be unrolled further. Thus, the retract gate can restrict babies and pets within a safe area.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A retract gate comprising:

an upper roller assembly comprising:

a housing;

a rolling mechanism accommodated in the housing and comprising:

a sleeve having:

upper teeth formed on an upper end of the sleeve; and surrounding teeth annually formed on an outer surface of the sleeve;

a differential crown gear having teeth;

a first crown gear having teeth, a number of the teeth of the first crown gear being less than that of the differential crown gear; and at least one gear engaging the upper teeth of the sleeve, the first crown gear, and the differential crown gear;

wherein the sleeve, the differential crown gear, and the first crown gear rotate coaxially; and a controlling mechanism accommodated in the housing and comprising:

a switch capable of moving relatively to the housing and engaging with the first crown gear, part of the switch extending out of the housing; and an engaging component selectively and slidably abutting the switch; the engaging component selectively sticking the differential crown gear;

a lower roller assembly;

an axial tube, one end of the axial tube connected with the sleeve, another end of the axial tube connected with the lower roller assembly; the axial tube rotated with the sleeve but rotated relatively to the lower roller assembly;

a holding pole; and a screen body, one end of the screen body securely fixed on the holding pole, another end of the screen body securely fixed on the axial tube; the screen body selectively rolled on an outer side of the axial tube;

wherein when the upper roller assembly is turned on by the switch, the switch releases the first crown gear and the engaging component releases the sleeve; and wherein when the upper roller assembly is turned off by the switch, the switch engages the first crown gear; meanwhile:

at a time when the engaging component sticks the differential crown gear, the engaging component engages the sleeve; and at a time when the engaging component releases the differential crown gear, the engaging component also releases the sleeve.

2. The retract gate as claimed in claim 1, wherein:

the first crown gear forms:

annular teeth arranged annularly; and the switch of the controlling mechanism comprises:

a first tooth portion on a side of the switch, the first tooth portion selectively engaging the annular teeth;

wherein when the upper roller assembly is turned on, the first tooth portion releases the annular teeth; when the upper roller assembly is turned off, the first tooth portion engages the annular teeth.

3. The retract gate as claimed in claim 2, wherein:

the first tooth portion of the switch is inclined; and the annular teeth of the first crown gear are inclined corresponding to the first tooth portion;

when the first tooth portion engages the annular teeth, the first crown gear is pushed and rotates in a rolling direction of the screen body.

4. The retract gate as claimed in claim 1, wherein:

the switch comprises:

a recess on a side of the switch, the recess forming:

a slope in a lower portion of the recess;

the differential crown gear forms:

a cavity on an outer periphery of the differential crown;

the engaging component comprises:

an engaging body comprising:

an abutting portion selectively abutting the recess and, while abutting the recess, the abutting portion being capable of sliding alternately on the slope of the recess and a bottom surface of the recess;

a stopping portion selectively sticking in the cavity of the differential crown gear; and a second tooth portion selectively engaging the sleeve;

a first elastic element sleeved on the differential crown gear; one end of the first elastic element fixed on the differential crown gear, another end of the first elastic element fixed on the engaging body;

when the switch is pulled up, the upper roller assembly is turned on, and thereby the abutting portion of the engaging component abuts an outermost portion of the slope of the switch so that the second tooth portion releases the sleeve;

when the switch is pressed down, the upper roller assembly is turned off, and thereby:

while the stopping portion sticks in the cavity of the differential crown gear, the abutting portion of the engaging component abuts the bottom surface of the recess and the second tooth portion of the engaging component engages the sleeve; and while the differential crown gear has been rotated so that the stopping portion abuts the outer periphery of the differential crown, the second tooth portion of the engaging component releases the sleeve.

5. The retract gate as claimed in claim 3, wherein:

the switch comprises:

a recess on a side of the switch, the recess forming:

a slope in a lower portion of the recess;

the differential crown gear forms:

a cavity on an outer periphery of the differential crown;

the engaging component comprises:

an engaging body comprising:

an abutting portion selectively abutting the recess and, while abutting the recess, the abutting portion being capable of sliding alternately on the slope of the recess and a bottom surface of the recess;

a stopping portion selectively sticking in the cavity of the differential crown gear; and a second tooth portion selectively engaging the sleeve;

a first elastic element sleeved on the differential crown gear; one end of the first elastic element fixed on the differential crown gear, another end of the first elastic element fixed on the engaging body;

when the switch is pulled up, the upper roller assembly is turned on, and thereby the abutting portion of the engaging component abuts an outermost portion of the slope of the switch so that the second tooth portion releases the sleeve;

when the switch is pressed down, the upper roller assembly is turned off, and thereby:

while the stopping portion sticks in the cavity of the differential crown gear, the abutting portion of the engaging component abuts the bottom surface of the recess and the second tooth portion of the engaging component engages the sleeve; and while the differential crown gear has been rotated so that the stopping portion abuts the outer periphery of the differential crown, the second tooth portion of the engaging component releases the sleeve.

6. The retract gate as claimed in claim 1, wherein:

the rolling mechanism further comprises:

a ring, the at least one gear rotatably mounted on the ring; and the switch forms:

at least one extending portion extending downward from a bottom of the switch, the at least one extending portion each forming:

a protrusion at an end of the extending portion, the protrusion selectively hooking the ring and thereby the ring being capable of moving with the switch while hooked.

7. The retract gate as claimed in claim 5, wherein:

the rolling mechanism further comprises:

a ring, the at least one gear rotatably mounted on the ring; and the switch forms:

at least one extending portion extending downward from a bottom of the switch, the at least one extending portion each forming:

a protrusion at an end of the extending portion, the protrusion selectively hooking the ring and thereby the ring being capable of moving with the switch while hooked.

8. The retract gate as claimed in claim 1, wherein:

the housing forms:

at least one sticking hole; and the switch comprises:

a first button movably mounted in the housing but part of the first button extending out of the housing, the first button forming:

a through hole; and a second button movably mounted in the through hole of the first button but part of the second button extending out of the first button;

a second elastic element abutting a bottom of the second button and retractably mounted in the first button, thereby part of the second elastic element selectively extending out of the first button and selectively sticking in the sticking hole of the housing.

9. The retract gate as claimed in claim 7, wherein:

the housing forms:

at least one sticking hole; and the switch comprises:

a first button movably mounted in the housing but part of the first button extending out of the housing, the first button forming:

a through hole; and a second button movably mounted in the through hole of the first button but part of the second button extending out of the first button;

a second elastic element abutting a bottom of the second button and retractably mounted in the first button, thereby part of the second elastic element selectively extending out of the first button and selectively sticking in the sticking hole of the housing.

10. The retract gate as claimed in claim 9, wherein the first button of the switch further forms:

the first tooth portion on a side of the first button;

the recess on a side of the first button; and the at least one extending portion extending downward from a bottom of the first button.

11. The retract gate as claimed in claim 1, wherein the sleeve comprises:

a gear sleeve having the surrounding teeth of the sleeve on an outer surface of the gear sleeve; and a second crown gear concentrically securely sleeved in the gear sleeve and having the upper teeth of the sleeve on an upper end of the second crown gear;

wherein the engaging component selectively engages the surrounding teeth of the gear sleeve, and the at least one gear is connected with the upper teeth of the second crown gear.

12. The retract gate as claimed in claim 10, wherein the sleeve comprises:

a gear sleeve having the surrounding teeth of the sleeve on an outer surface of the gear sleeve; and a second crown gear concentrically securely sleeved in the gear sleeve and having the upper teeth of the sleeve on an upper end of the second crown gear;

wherein the engaging component selectively engages the surrounding teeth of the gear sleeve, and the at least one gear is connected with the upper teeth of the second crown gear.

13. The retract gate as claimed in claim 1, wherein the housing forms:

an accommodating space on a top of the housing; the controlling mechanism accommodated in the accommodating space of the housing; and a fixing rod, one end of the fixing rod mounted on an outer surface of a bottom of the accommodating space; the first crown gear and the sleeve sleeved on the fixing rod in series from top to bottom.

14. The retract gate as claimed in claim 12, wherein the housing forms:

an accommodating space on a top of the housing; the controlling mechanism accommodated in the accommodating space of the housing; and a fixing rod, one end of the fixing rod mounted on an outer surface of a bottom of the accommodating space; the first crown gear, the ring, and the second crown gear of the sleeve sleeved on the fixing rod in series from top to bottom.

15. The retract gate as claimed in claim 1, wherein the lower roller assembly comprises:

a base;

a lid mounted on the base; and a collar sleeved on the base;

wherein the axial tube is sleeved on the collar.

16. The retract gate as claimed in claim 14, wherein the lower roller assembly comprises:

a base;

a lid mounted on the base; and a collar sleeved on the base;

wherein the axial tube is sleeved on the collar.

17. The retract gate as claimed in claim 1 further comprising:

at least one fixing stand, the holding pole detachably mounted in the at least one fixing stand.

18. The retract gate as claimed in claim 16 further comprising:

at least one fixing stand, the holding pole detachably mounted in the at least one fixing stand.

19. The retract gate as claimed in claim 1, wherein the holding pole comprises:

a handle comprising:

a push bolt;

a pole abutted by the push bolt and thereby the push pole being capable of being mounted on a fixing stand; and a third elastic element mounted on the pole.

20. The retractable gate as claimed in claim 18, wherein: the holding pole comprises:

a handle comprising:

a push bolt;

a pole abutted by the push bolt and thereby the push pole being capable of being mounted on a fixing stand; and a third elastic element mounted on the pole.

* * * * *